US007121245B2

(12) United States Patent
Tanaka et al.

(10) Patent No.: US 7,121,245 B2
(45) Date of Patent: Oct. 17, 2006

(54) INJECTION CONTROL DEVICE FOR FUEL INJECTION PUMP

(75) Inventors: Masamichi Tanaka, Osaka (JP); Hajimu Imanaka, Osaka (JP)

(73) Assignee: Yanmar Co., Ltd., Osaka (JP)

( * ) Notice: Subject to any disclaimer, the term of this patent is extended or adjusted under 35 U.S.C. 154(b) by 0 days.

(21) Appl. No.: 11/295,446

(22) Filed: Dec. 7, 2005

(65) Prior Publication Data

US 2006/0112936 A1 Jun. 1, 2006

Related U.S. Application Data

(63) Continuation of application No. PCT/JP2004/006219, filed on Apr. 28, 2004.

(30) Foreign Application Priority Data

Jun. 12, 2003 (JP) ..... 2003-167944

(51) Int. Cl.
*F02D 41/06* (2006.01)

(52) U.S. Cl. ..... 123/179.17

(58) Field of Classification Search ..... 123/179.12, 123/179.16, 179.17, 479, 491
See application file for complete search history.

(56) References Cited

U.S. PATENT DOCUMENTS 3,646,915 A * 3/1972 Rachel ..... 123/491
4,763,625 A * 8/1988 Staerzl et al. ..... 123/435
5,133,311 A * 7/1992 Hallgren ..... 123/179.1
5,469,825 A * 11/1995 Golab et al. ..... 123/479
5,752,488 A * 5/1998 Hattori et al. ..... 123/491
5,836,288 A * 11/1998 Nakagawa ..... 123/491
6,557,509 B1 * 5/2003 Hall et al. ..... 123/179.16

FOREIGN PATENT DOCUMENTS

JP 08-276800 10/1996
JP 2000-234576 8/2000

OTHER PUBLICATIONS

International Search Report for International Application No. PCT/JP2004/006219, Japanese Patent Office, mailed Jul. 6, 2004.

* cited by examiner

*Primary Examiner*—Thomas Moulis
(74) *Attorney, Agent, or Firm*—Sterne, Kessler, Goldstein & Fox P.L.L.C.

(57) ABSTRACT

In an injection control device for a fuel injection pump comprising: a water temperature sensor; a cold start device (CSD) for advancing a fuel injection timing to an engine when started up in a low temperature; and a controller, the controller recognizes a value T of water temperature by a signal from the water temperature sensor, and activates the CSD when the engine is started up and when the value of water temperature recognized by the controller (recognized value T of water temperature) is lower than a threshold value Tc of water temperature. If a value V of voltage of a power source of the controller becomes lower than a threshold value Vn of the voltage of the power source during activation of the CSD, a value Tn of water temperature recognized by the controller immediately before the value of voltage of the power source becomes lower than the threshold value of voltage of the power source is maintained as the value T of water temperature recognized by the controller for activating the cold start device.

1 Claim, 5 Drawing Sheets

INJECTION CONTROL DEVICE FOR FUEL INJECTION PUMP

CROSS-REFERENCE TO RELATED APPLICATION

The present application is a Continuation of PCT Application No. PCT/JP2004/006219, filed Apr. 28, 2004, which is hereby incorporated in its entirety herein by reference thereto.

BACKGROUND OF THE INVENTION

1. Field of the Invention

The present invention relates to a fuel injection pump with an electronic governor and a device for advancing a fuel injection timing to a diesel engine when started up in a low temperature, and particularly, to a technology for preventing an operational error of the cold start device.

2. Background Art

Conventionally, there are well-known fuel injection pumps for diesel engines, each comprising a plunger, a plunger barrel, a distribution shaft, and delivery valves, wherein the plunger is vertically reciprocated in the plunger barrel to send pressurized fuel to the distribution shaft, the distribution shaft distributes the fuel from the plunger among the delivery valves, and the delivery valves send fuel to respective fuel injection nozzles. Some of the well-known fuel injection pumps each includes a controller mainly composed of a computer electrically controlling the injection quantity and timing of fuel to the engine. Further, some of the electrically controlled fuel injection pumps each includes a device for advancing a fuel injection timing to a diesel engine when started up in a low temperature ("Cold Start Device", hereinafter, referred to as "CSD") for changing the injection timing of fuel, as disclosed in Japanese Laid Open Gazette No. 2000-234576.

The controller controls an electronic governor and the CSD with software previously installed therein and on the basis of signals from a rotary sensor and a water temperature sensor connected to the controller, so as to control the injection quantity and timing of fuel to the engine.

The CSD includes an injection-advancing actuator which is operated by the controller to open and close an overflowing sub port formed in the plunger barrel so as to change the injection timing. More specifically, when an engine in a low temperature is started up, the CSD performs an injection-advancing control to advance the injection timing which is a timing for closing the overflowing sub port, thereby smoothening the start-up of the engine. The controller electrically controls the injection-advancing actuator for opening and closing the overflowing sub port. In this control, the water temperature sensor connected to the controller detects a temperature of cooling water of the engine, and the controller measures the detected temperature of cooling-water. To start up the engine, when the water temperature value measured by the controller is lower than a threshold value of water temperature, i.e., during start-up of the engine in a low temperature, the controller activates the injection-advancing actuator of the CSD so as to perform the injection-advancing control.

However, with respect to a control device including the above-mentioned controller, during start-up of the engine, driving of a selmotor lowers battery voltage, i.e., voltage of a power source of the controller, whereby the controller mismeasures temperature. When the error of measurement becomes large, the controller recognizes a temperature value that is higher than an actual temperature. If the water-temperature value recognized by the controller exceeds the above-mentioned threshold water-temperature value because of the mismeasurement of water-temperature by the controller in which the actual temperature of engine-cooling water is not reflected, the command from the controller to the injection-advancing actuator may be canceled so as to inactivate the CSD, so that the engine cannot be smoothly started up.

This phenomenon will be described with reference to measurement data of FIG. 5.

FIG. 5 graphs variations of an engine rotary speed N, a controller power source voltage (battery voltage) V, and a water-temperature value T recognized by a controller based on a signal from a water-temperature sensor, in relation to time t (water-temperature value T does not always coincide with actual water temperature).

Time t equaling to 0 is defined as a time when a starter is switched on and an engine starts cranking. The cranking is started immediately the controller activated by switching-on of a power source of the controller recognizes a starter signal and starts rotating a selmotor. The moment electric power is applied to the selmotor, voltage of the controller power source is temporarily lowered (as represented by a portion Va in FIG. 5). In this measurement, the minimum of measured lowered controller power source voltage attains 5.3V. During this lowering of the controller power source voltage, the controller mismeasures the water-temperature signal from the water-temperature sensor so as to decide on a high water-temperature value (as represented by a portion Ta in FIG. 5) against actual water-temperature. Consequently, it may happen that the controller cannot recognize a right water-temperature value against the above-mentioned temporary lowering of voltage.

The controller is adapted to cancel the activation command to the CSD when it recognizes the water-temperature rising above a certain preset value (normally, about 5° C.). That is, due to the mismeasurement of the controller about the water-temperature caused by the lowering of battery voltage at the time of cranking of the engine, the controller recognizes the water-temperature rising to about 300C during the short period of lowering the battery voltage, and cancels the activation command to the CSD. In other words, due to the mis-recognition of the controller about the engine-cooling water temperature caused by the lowering of the controller power source voltage, the CSD is misoperated (inactivated) in disregard of the actual cooling-water temperature, thereby inhibiting the engine from being smoothly started up in a low temperature.

An object of the invention is prevention of the misoperation of the CSD during engine-start in a lower temperature caused by the wrong recognition of the controller about cooling-water temperature due to the lowering of the controller power source voltage when an engine is started up, thereby ensuring stable start-up of the engine in a low temperature.

BRIEF SUMMARY OF THE INVENTION

According to the invention, an injection control device for a fuel injection pump comprises: a water temperature sensor; a cold start device for advancing a fuel injection timing to an engine when started up in a low temperature; and a controller. The controller recognizes a value of water temperature by a signal from the water temperature sensor, and activates the cold start device when the engine is started up and when the value of water temperature recognized by the controller is lower than a threshold value of water temperature. If a value of voltage of a power source of the controller becomes lower than a threshold value of the voltage of the power source during activation of the cold start device, a value of water temperature recognized by the controller immediately before the value of voltage of the power source becomes lower than the threshold value of voltage of the power source is maintained as the value of water temperature recognized by the controller for activating the cold start device. Accordingly, the unexpected increase of the wrongly recognized value of water temperature caused by the lowering of voltage of the power source of the controller is surely prevented so as to prevent the controller from canceling a command for activating the cold start device (CSD). That is, the CSD is prevented from being wrongly operated, thereby surely starting up the engine in a low temperature.

BRIEF DESCRIPTION OF THE DRAWINGS/FIGURES

DETAILED DESCRIPTION OF THE INVENTION

Best Mode for Carrying Out the Invention

A fuel injection pump 1 according to the present invention is adapted to be mounted on a diesel engine. A structure of fuel injection pump 1 will be described, on the assumption that a left side of FIG. 1 is stated as a front side of fuel injection pump 1 in the hereinafter description.

Figure 1:
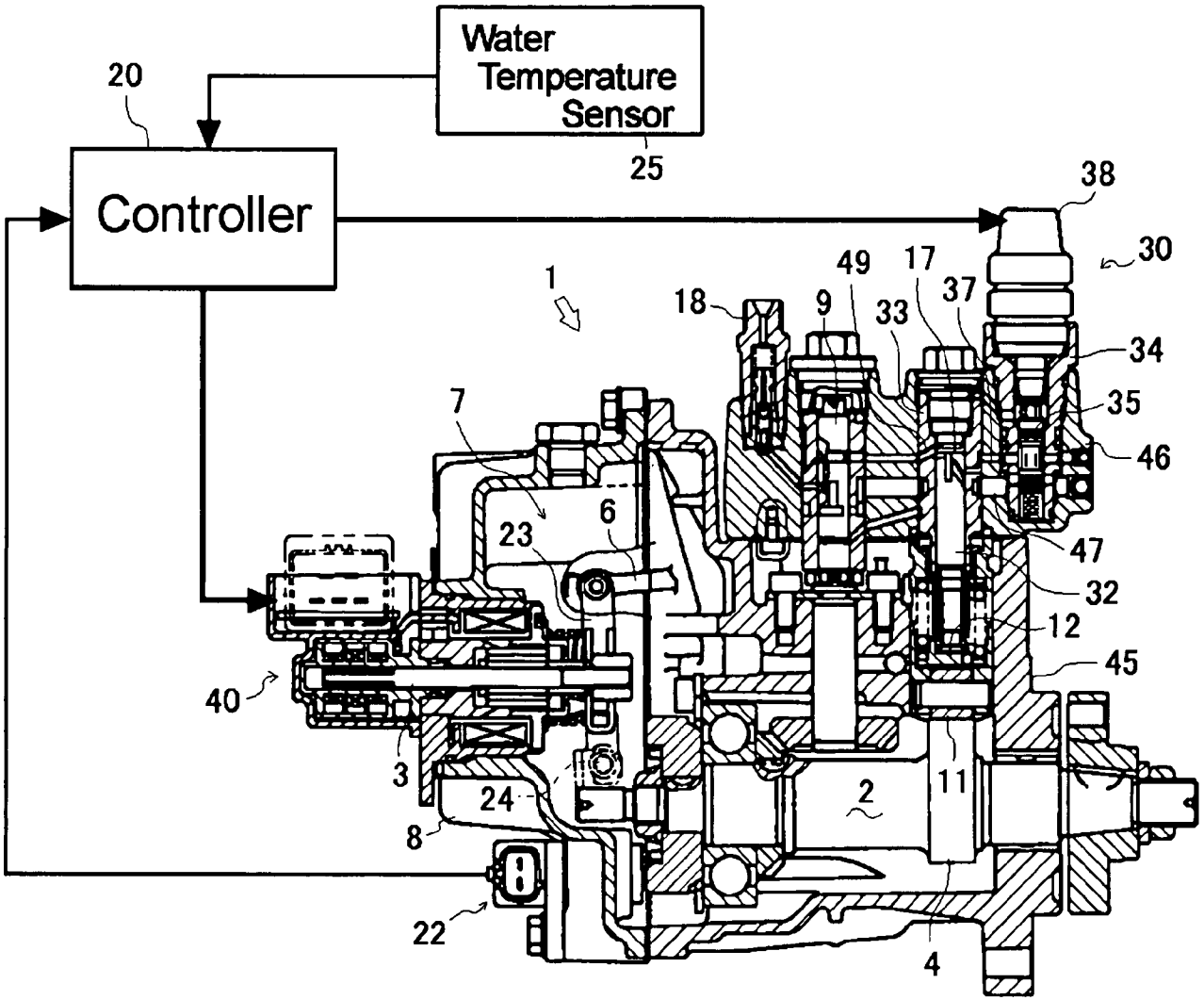
FIG. 1 is a partly sectional structural view of a fuel injection pump according to the present invention, combined with a diagram of a control system for the fuel injection pump.

As shown in FIG. 1, fuel injection pump 1 comprises a pump housing 45 and a hydraulic head 46, which are vertically joined to each other. A casing 8 of an electronic governor 7 is attached onto a front surface of pump housing 45. A rack actuator 40 is fixedly inserted into casing 8 from the forward side.

Rack actuator 40 moves a slide shaft 3 forward and backward. A tip end of slide shaft 3 is pivoted onto an intermediate portion of a link lever 23.

Link lever 23 is disposed so as to be rotatable around a base pin 24 at a lower portion thereof. Link lever 23 is pivotally connected at a top portion thereof to a control lever 6. Due to the forward-and-backward movement of slide shaft 3, link lever 23 rotates in the fore-and-aft direction centered on base pin 24, thereby moving control lever 6 in the fore-and-aft direction for operating a governing rack (not shown) for rotating a plunger 32, i.e., thereby increasing or decreasing the quantity of fuel injection.

Figure 2:
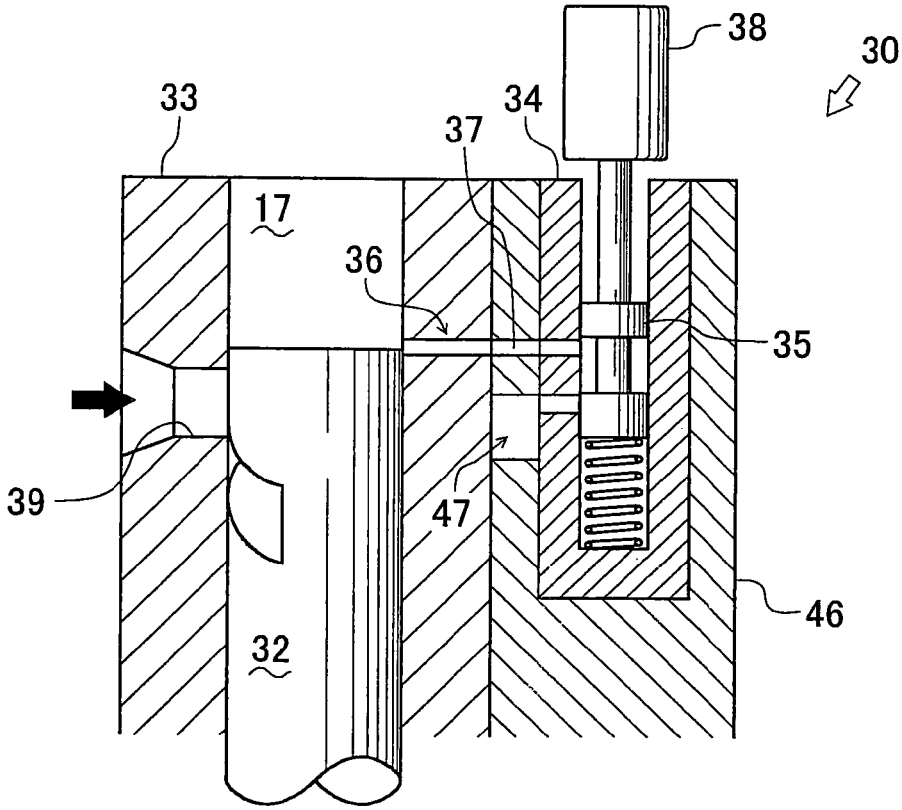
FIG. 2 is a sectional view of a CSD.

As shown in FIGS. 1 and 2, a plunger barrel 33 is fitted in hydraulic head 46, and a plunger is vertically reciprocally slidably fitted in plunger barrel 32. Plunger 32 is vertically reciprocated via a tappet 11 and a lower spring stay 12 by rotation of a cam 4 formed on a pump camshaft 2. Plunger barrel 33 is formed therein with a main port 39 constantly supplied with fuel charged from a fuel supply section (not shown). When plunger 32 reaches the bottom portion of the vertical reciprocation range thereof (a lower dead point), main port 39 is fluidly connected to a fuel compression chamber 17 formed in an upper portion of plunger barrel 33, so as to introduce fuel into fuel compression chamber 17. When plunger 32 is pushed upward by cam 4, an outer wall of plunger 32 comes to close an opening of main port 39 to be fluidly connected to fuel compression chamber 17. Accordingly, as plunger 32 moves upward, fuel in fuel compression chamber 17 is sent from a distribution port 49 penetrating plunger barrel 33 to delivery valves 18 via a distribution shaft 9, and fuel from delivery valves 18 is injected into respective cylinders via respective fuel injection valves provided in a cylinder head of the engine.

A rotary sensor for detecting the rotary speed of pump camshaft 2 is attached onto a lower portion of casing 8.

A cold start device (hereinafter, referred to "CSD 30") is disposed in hydraulic head 46 behind plunger barrel 33. CSD 30 includes a piston barrel 34 fitted into hydraulic head 46. Piston barrel 34 is formed therein with a piston slide portion, in which a piston as a CSD timer (hereinafter referred to "CSD 30") is provided so as to be slidable upward and downward. CSD 30 includes an injection-advancing actuator 38 for upwardly or downwardly sliding piston 35.

As shown in FIG. 2, an overflowing sub port 36 is formed in plunger barrel 33 so as to be hydraulically connected to piston barrel 34 via a drain passage 37.

In a normal temperature (in the warmed engine condition), CSD 30 is inactivated so that piston 35 is disposed at the lowest position so as to connect overflowing sub port 36 to a low-pressurized chamber 47 via drain passage 37, thereby setting a normal fuel injection timing.

When an engine in a low temperature is started up (in the unwarmed engine condition), CSD 30 is activated so as to activate injection-advancing actuator 38 for moving piston 35 upward so as to divide drain passage 37 and separate overflowing sub port 36 from lower-pressurized chamber 47, thereby advancing the fuel injection timing.

With respect to such fuel injection pump 1, electronic governor 7 controls the fuel injection quantity, and CSD 30 controls the advancing of fuel injection timing during start-up of the engine in a low temperature. As shown in FIG. 1, controller 20 produces control signals to electronic governor 7 and CSD 30. In this regard, rotary sensor 20 for detecting the rotary speed of pump camshaft 2 and a water temperature sensor 25 for detecting the temperature of cooling water of the engine are connected to controller 20. Controller 20 produces the control signals to electronic governor 7 and CSD 30 on the basis of detection signals from rotary sensor 22 and water temperature sensor 25 and on the basis of a program or the like previously installed in controller 20.

Rack actuator 40 of electronic governor 7 and injection-advancing actuator 38 of CSD 30 are connected to controller 20, so that, according to the control signals produced by controller 20, rack actuator 40 is controlled so as to control electronic governor 7, and injection-advancing actuator 38 is controlled so as to control CSD 30.

Due to the above structure, when a cooling-water temperature value of the engine (recognized water-temperature value T), which controller 20 recognizes by the detection signal from water temperature sensor 25, is lower than a preset threshold water-temperature value Tc during start-up of the engine, i.e., when the engine in a low temperature is started up, controller 20 activates injection-advancing actuator 38 for advancing the injection timing.

Conventionally, controller 20 sometimes mismeasures the signal from water temperature sensor 25 because of a lowering of voltage of a power source of controller 20 caused by electrically driving a selmotor for starting up an engine. Therefore, according to the invention, controller 20 is provided with control means for preventing the wrong activation of CSD 30 caused by the wrong recognition of controller 20.

In this regard, the present invention is adapted to prevent controller 20 from wrongly deciding on water-temperature value T exceeding threshold water-temperature value Tc. An example of this control manner will be described as follows.

Figure 3:
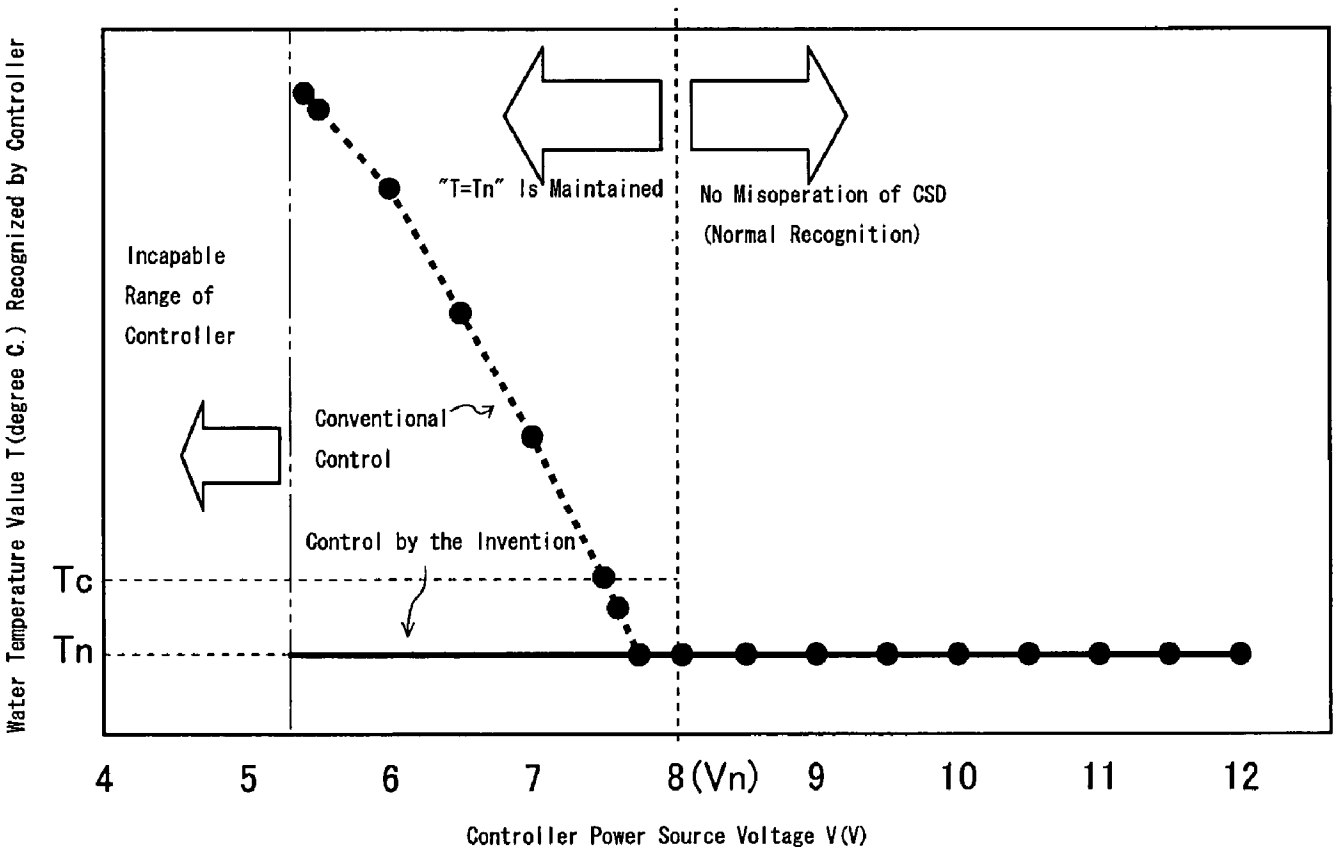
FIG. 3 is a graph indicating how the voltage of a controller power source influences a value of water temperature recognized by a controller.

Each of graphs of FIG. 3 indicates measured value T of water temperature recognized by controller 20 relative to a voltage V of the power source of controller 20. As understood from the graphs, unless controller power source voltage V is lower than a certain value Vn (in this embodiment, 8V), recognized water-temperature value T is kept substantially constant by a dummy resistance or the like, thereby preventing controller 20 from mismeasuring the detection signal from water temperature sensor 25. In the conventional control, when controller power source value V becomes lower than value Vn, controller 20 mismeasures the detection signal from water temperature sensor 25, that is, water-temperature value T recognized by controller 20 is increased as controller power source voltage V is lowered, regardless of actual variation of water temperature. If controller power source voltage V is lowered to a limit voltage for activating controller 20, controller 20 is disabled.

In this regard, since controller 20 wrongly recognizes a water temperature because of the lowering of voltage V of the power source of controller 20 caused by the engine start-up, water-temperature value T recognized by controller 20 exceeds threshold water-temperature value Tc so that controller 20 commands a wrong signal to CSD 30, thereby misoperating (i.e., inactivating) CSD 30.

Therefore, according to the present invention, a minimum value of controller power source voltage V for surely preventing controller 20 from mismeasuring the signal from water temperature sensor 25 or a value close to the minimum value is determined as threshold value Vn. When power source voltage V becomes lower than certain value Vn, a water-temperature value Tn recognized by controller 20 immediately before controller power source voltage V becomes lower than threshold value Vn (hereinafter, referred to as "previous water-temperature value Tn") is maintained as water-temperature value T recognized by controller 20.

In this regard, unless controller power source voltage V is lower than threshold value Vn, controller 20 recognizes the water temperature signal from water temperature sensor 25 as it is because controller 20 has no possibility of mismeasuring the signal from water temperature 25. On the other hand, when controller power source voltage V becomes lower than threshold value Vn, a water-temperature value recognized by controller 20 immediately before controller power source voltage V becomes lower than threshold value Vn, i.e, previous water-temperature value Tn is determined as water-temperature value T recognized by controller 20, and controller 20 maintains previous water-temperature value Tn to be recognized while power source voltage V is lower than threshold value Vn. According to this control, controller 20 is prevented from wrongly recognizing unexpectedly increased water-temperature value T because of the lowering of power source voltage V, thereby being prevented from wrongly canceling the activation command from controller 20 to CSD 30 during start-up of the engine in a low temperature. In this way, the misoperation of CSD 30 is prevented so as to ensure an optimal start-up of the engine.

Figure 4:
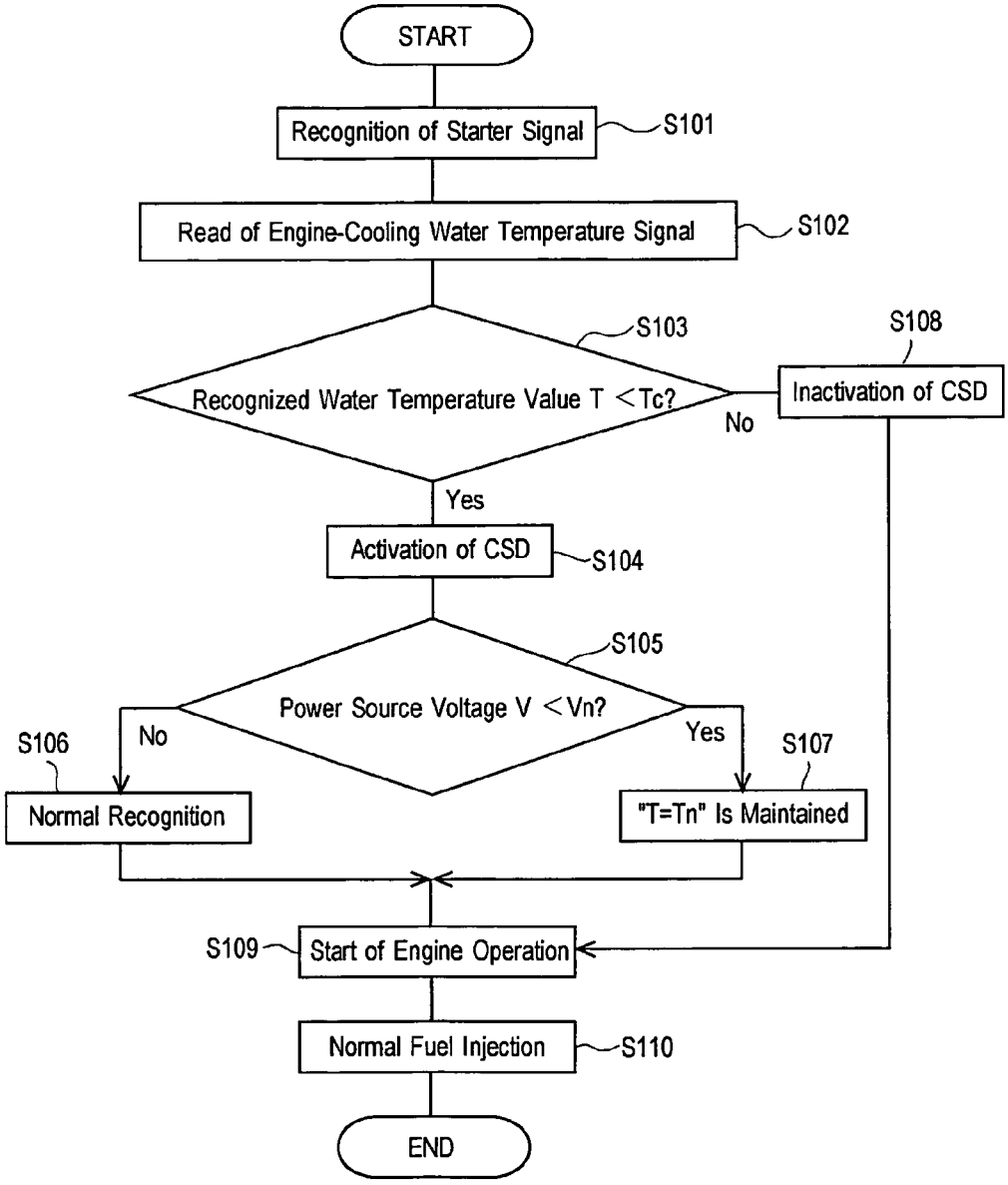
FIG. 4 is a flowchart indicating a process for controlling the cold start device of the present invention.
Figure 5:
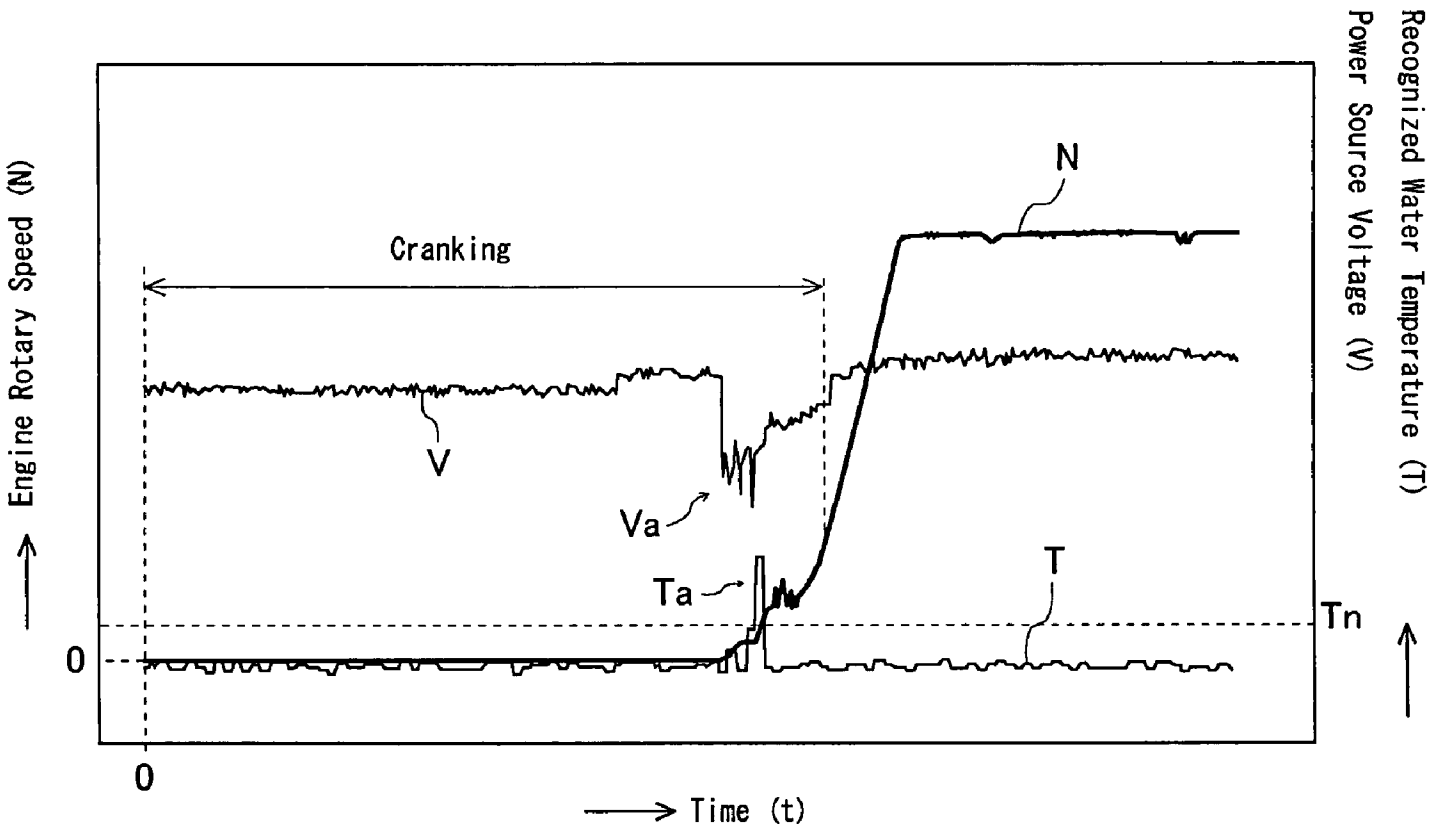
FIG. 5 illustrates graphs of variation of engine rotary speed, variation of voltage of the controller power source and variation of water temperature recognized by the controller in a conventional manner.

A control process of controller 20 for preventing the misoperation of CSD 30 will be described with reference to a flowchart of FIG. 4.

When a key switch (not shown) is switched on, the power source of controller 20 is switched on so as to set controller 20 into the activation state. Then, when a starter switch (not shown) for cranking of an engine is switched on, a signal indicating the switching on of the starter switch is inputted into controller 20, and controller 20 recognizes the starter signal and rotates a selmotor (not shown), thereby starting the cranking (S101).

At this time, controller 20 reads a water-temperature signal about the temperature of cooling-water of the engine (S102). The water-temperature signal is detected by water-temperature sensor 25, sent to controller 20, and recognized by controller 20. The value recognized by controller 20 is referred to as a recognized water-temperature value T.

At this time, controller 20 judges whether or not recognized water-temperature value T is lower than a preset water-temperature value Tc previously stored in controller 20 (S103). When controller 20 decides that recognized water-temperature value T is lower than preset water-temperature value Tc, the process is advanced to a step S104. When controller 20 decides that recognized water-temperature value T is not lower than preset water-temperature value Tc, the process is advanced to a step S108.

The condition that recognized water-temperature value T is lower than preset water-temperature value Tc, decided by controller 20 at step S103, is regarded as the condition of the engine started up in a low temperature. Therefore, controller 20 sends an activation command signal to injection-advancing actuator 38 of CSD 30, so as to activate CSD 30 (S104).

When CSD 30 is activated at step S104, controller 20 constantly detects a controller power source voltage V of the power source of controller 20 and judges whether or not power source voltage V is lower than a threshold value Vn (S105). The judge depends on comparison of actual detected controller power source voltage V with threshold value Vn previously stored in controller 20. According to the judge at step S105, when controller power source voltage V is decided not to be lower than threshold value Vn, i.e., unless controller power source voltage V is lower than threshold value Vn, controller 20 normally recognizes water-temperature value T on the basis of the signal from water-temperature sensor 25 because the fear of wrong recognition of the detection signal from water-temperature sensor 25 by controller 20 does not exist (S106).

On the other hand, according to the judge at step S105, when controller power source voltage V is judged to be lower than threshold value Vn, previous water-temperature value Tn recognized by controller 20 immediately before controller power source voltage V becomes lower than threshold value Vn is determined as water-temperature value T recognized by controller 20. Previous water-temperature value Tn is maintained while power source voltage V is lower than threshold value Vn (S107).

In this regard, during the activation of CSD 30, the normal judge by controller 20 at step S105 is constantly performed. When controller power source voltage V is lower than threshold value Vn, controller 20 applies previous water-temperature value Tn to recognized water-temperature value T. Unless controller power source voltage V is lower than threshold value Vn, controller 20 certainly measures the signal from water-temperature sensor 25.

In this way, the engine started up under the control of recognized water-temperature value T by controller 20 is transferred into the normal driving state, i.e., the engine starts its regular driving (S109).

On the other hand, the condition judged by step S103 that water-temperature value T recognized by controller 20 is not lower than preset water-temperature value Tc is regarded as normal start-up of the engine (in a normal temperature). Therefore, controller 20 does not send the activation command to CSD 30, and the engine is normally started up in the inactivation condition of CSD 30 (S108), and then, the process is advanced to step S109.

When the engine starts its regular driving, the starter switch is switched off. When the starter switch is switched off, the starter signal to controller 20 is canceled. At this time, if it is under the activation condition of CSD 30, the activation command from controller 20 to CSD 30 is canceled simultaneously with the cancel of the starter signal, whereby controller 20 starts its normal fuel injection control (S110).

In other words, as the graph resulting from the invention in FIG. 3, in the condition that controller 20 recognizes the starter signal and CSD 30 is activated (during the start-up of the engine in a low temperature), and when voltage V of the power source of controller 20 is lower than threshold value Vn, controller 20 performs the above-mentioned control for prevention of the mis-recognition, such that previous water-temperature value Tn recognized by controller 20 immediately before controller power source voltage V becomes lower than threshold value Vn is determined as water-temperature value T recognized by controller 20, and that previous water-temperature value Tn is maintained while controller power source voltage V is lower than threshold value Vn.

Due to this control of the present invention, water-temperature value T recognized by controller 20 is prevented from rising during the activation of CSD 30 (during the engine start-up in a low temperature) caused by the lowering of controller power source voltage V of controller 20.

In this way, water-temperature value T recognized by controller 20 is controlled to prevent wrong recognition of controller 20 caused by the lowering of controller power source voltage V of controller 20 and resulting in the unexpected rising of recognized water-temperature value T, thereby preventing misoperation of CSD 30 during the engine start-up in a low temperature. In addition to CSD 30, every implement controlled by controller 20 based on signals from water-temperature sensor 25 can also be prevented from being misoperated so as to ensure appropriate start-up of the engine in a low temperature.

The above-mentioned manner of controlling water-temperature recognized by controller 20 is applicable to any conventional electronic control unit, whose controller is mainly composed of a computer and controls a device based on a detection signal from a water-temperature sensor detecting engine-cooling water. For example, with respect to a conventional EGR (exhaust gas recirculation) system to be attached to an engine, controller 20 can use the manner for controlling an opening degree of an EGR valve based on a detection signal from water-temperature sensor 25, so as to adjust the quantity of EGR when the engine is started up in a low temperature.

Further, the judgment by controller 20 does not depend on only the detection signal from water-temperature sensor 25. For example, with respect to an engine with a supercharger widely used to ships and large-size vehicles, controller 20, which recognizes acceleration or deceleration based on a detection signal from rotary sensor 22 during acceleration or deceleration, can use the manner for controlling the amount of air supplied for combusting fuel. In this case, due to the manner, when controller power source voltage V of controller 20 becomes lower than threshold value Vn, controller 20 maintains the previous value recognized by controller 20 based on the detection signal from rotary sensor 22 immediately before controller power source voltage V of controller 20 becomes lower than threshold value Vn.

In this regard, due to the control according to the present invention, any device, which is electrically controlled by controller 20 on the basis of a signal sent from any sensor to controller 20 and which may be misoperated by wrong recognition of controller 20 about the detection signal from the sensor because of irregular change of voltage of a power source of controller 20, is prevented from being misoperated.

INDUSTRIAL APPLICABILITY

As understood from the hereinbefore description, the invention is broadly applicable to fuel injection pumps for diesel engines each including an electronic governor and a cold start device.

What is claimed is:

1. An injection control device for a fuel injection pump comprising:

(a) a water temperature sensor;

(b) a cold start device for advancing a fuel injection timing to an engine when started up in a low temperature; and (c) a controller, wherein the controller recognizes a value of water temperature by a signal from the water temperature sensor, and activates the cold start device when the engine is started up and when the value of water temperature recognized by the controller is lower than a threshold value of water temperature, and wherein, if a value of voltage of a power source of the controller becomes lower than a threshold value of the voltage of the power source during activation of the cold start device, a value of water temperature recognized by the controller immediately before the value of voltage of the power source becomes lower than the threshold value of voltage of the power source is maintained as the value of water temperature recognized by the controller for activating the cold start device.

* * * * *